US007000423B2

(12) United States Patent
Lifson et al.

(10) Patent No.: US 7,000,423 B2
(45) Date of Patent: Feb. 21, 2006

(54) DUAL ECONOMIZER HEAT EXCHANGERS FOR HEAT PUMP

(75) Inventors: Alexander Lifson, Manlius, NY (US); Michael F. Taras, Fayetteville, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 292 days.

(21) Appl. No.: 10/692,511

(22) Filed: Oct. 24, 2003

(65) Prior Publication Data

US 2005/0086969 A1 Apr. 28, 2005

(51) Int. Cl.
*F25B 13/00* (2006.01)

(52) U.S. Cl. ..... 62/324.1; 62/113; 62/513

(58) Field of Classification Search ..... 62/113, 62/117, 222, 324.1, 325, 513
See application file for complete search history.

(56) References Cited

U.S. PATENT DOCUMENTS 4,876,859 A 10/1989 Kitamoto
5,095,712 A * 3/1992 Narreau ..... 62/113
5,174,123 A * 12/1992 Erickson ..... 62/113
5,875,637 A 3/1999 Paetow
6,047,556 A 4/2000 Lifson
6,206,652 B1 3/2001 Caillat

OTHER PUBLICATIONS

Systems & Advanced Technologies Engineering S.r.I., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner*—Melvin Jones
(74) *Attorney, Agent, or Firm*—Carlson, Gaskey & Olds

(57) ABSTRACT

A refrigerant system is operable in either a heating mode or cooling mode. The system is also provided with an economizer cycle that will function in either heating mode or cooling mode. A pair of economizer heat exchangers are positioned adjacent to an air conditioning economizer expansion device, and a heat pump economizer expansion device, respectively. A control for the system will control the opening either the air conditioning economizer expansion device or the heat pump economizer expansion device, dependent on whether economized operation is desired, and whether the system is in cooling or heating mode. Thus, a pair of heat exchangers are utilized, with one being selected for economizer operation dependent on whether the system is in cooling or heating mode.

5 Claims, 3 Drawing Sheets

DUAL ECONOMIZER HEAT EXCHANGERS FOR HEAT PUMP

BACKGROUND OF THE INVENTION

This invention relates to a refrigerant system that is utilized in both heating and cooling modes, and wherein an economizer cycle is provided in both modes with a pair of alternate economizer heat exchangers.

Conventional refrigerant systems provide cooled air in an air conditioning mode and a heated air in a heat pump mode. Essentially, the refrigerant flow through the system is reversed to provide the two distinct modes.

One modern development in refrigerant cycles is the inclusion of an economizer cycle. An economizer cycle taps a portion of a refrigerant flow downstream of the outdoor heat exchanger in cooling mode or downstream of the indoor heat exchanger in heating mode. The tapped refrigerant is used to subcool the main refrigerant flow. The tapped refrigerant passes through an expansion device, where its temperature is reduced during the expansion process, and then through an economizer heat exchanger. In the heat exchanger, the tapped refrigerant exchanges heat with the main refrigerant flow. The tapped refrigerant is then returned to an economizer port of a compressor after having cooled the main refrigerant flow.

While economizer cycles are known in dedicated air conditioning cooling systems, and have been proposed for operation in heating mode of heat pump systems, there have been no effective solutions for combined air conditioning and heat pump systems that incorporate an economizer cycle, that can be used in the system during either cooling or heating mode of operation.

SUMMARY OF THE INVENTION

In a disclosed embodiment of this invention, there are alternative economizer paths and heat exchangers for cooling and heating modes of a combined air conditioning and heat pump refrigerant system.

In cooling mode, a portion of the refrigerant downstream of the outdoor heat exchanger is tapped through a first expansion device, and through an air conditioning economizer heat exchanger. In the air conditioning economizer heat exchanger, heat is exchanged with the main refrigerant flow, cooling this main refrigerant flow. The tapped refrigerant is returned through a return line to an intermediate compression point in the compressor.

At the same time, a heat pump economizer heat exchanger path has its own expansion device. When the system operates in cooling mode, this expansion device is closed, blocking flow through this heat exchanger.

When the system is in heating mode, the air conditioning expansion device is closed, and the heat pump expansion device is opened. The tapped refrigerant passes through the heat pump expansion device, and the heat pump economizer heat exchanger, subcooling the main refrigerant flow during heating mode. The tapped refrigerant is returned to the compressor as before.

Of course, both the heat pump and air conditioning expansion devices can be closed, and the system will be operating in conventional non-economizing mode. The decision of when to utilize the economizer cycle is within the skill of a worker in this art, and forms no portion of this invention. Moreover, while a single economizer expansion device that also serves as a shut-off valve is shown, two separate devices could be utilized.

These and other features of the present invention can be best understood from the following specification and drawings, the following of which is a brief description.

DETAILED DESCRIPTION OF THE PREFERRED EMBODIMENT

Figure 1:
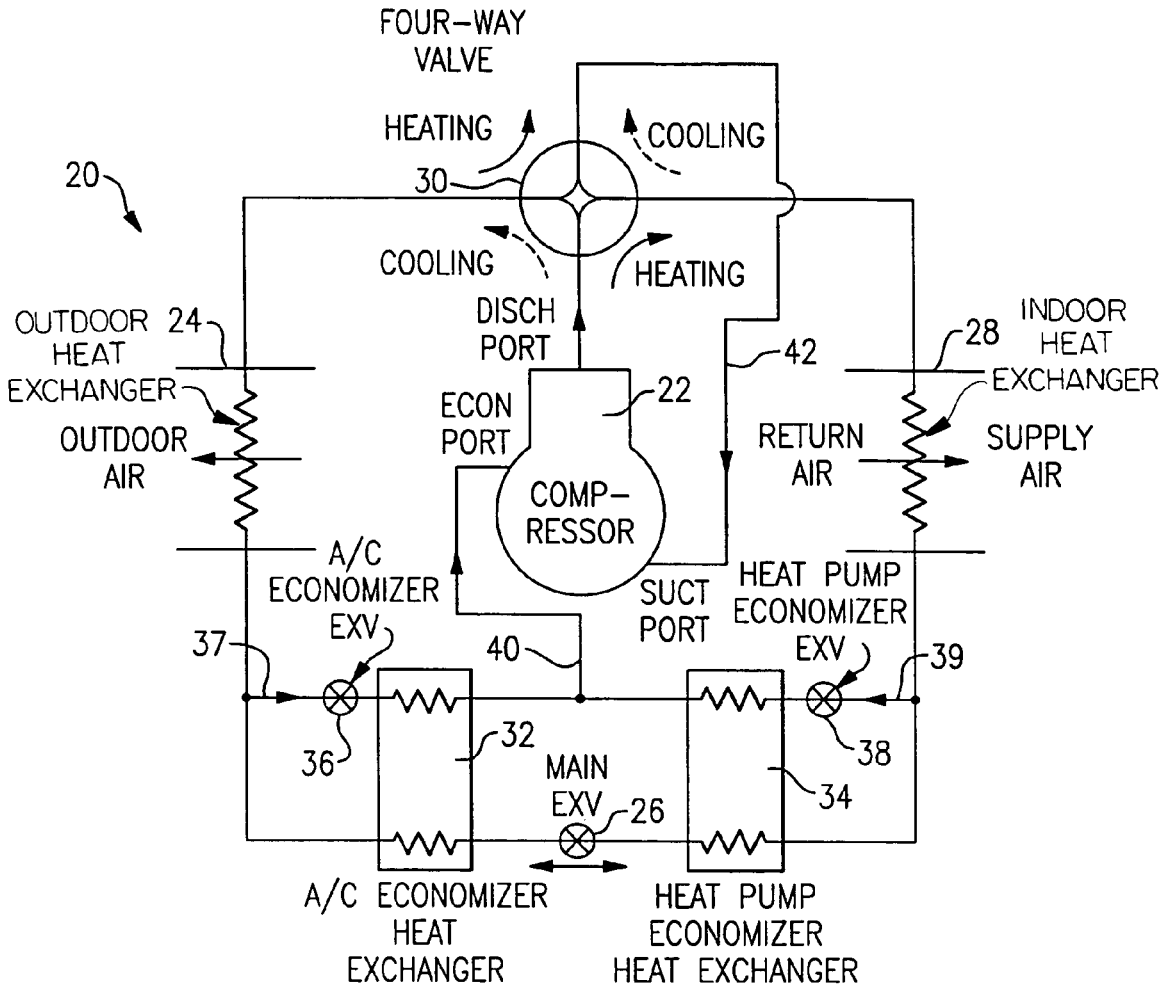
FIG. 1 is a schematic view showing an overall refrigerant cycle.

FIG. 1 shows a refrigerant cycle 20, having a compressor 22. Compressor 22 is preferably a scroll compressor, however, this invention extends to other compressor types.

An outdoor heat exchanger 24 exchanges heat in a refrigerant flow with outdoor air. The main expansion device 26 is positioned downstream of the outdoor heat exchanger 24, and an indoor heat exchanger 28 exchanges heat with an indoor air. A four-way reversing valve 30 controls the flow of refrigerant from the compressor 22 either initially to the outdoor heat exchanger 24 (cooling mode) or to the indoor heat exchanger 28 (heating mode).

An air conditioning economizer heat exchanger 32 is positioned adjacent to a heat pump economizer heat exchanger 34. A hard shutoff expansion device 36 selectively allows the flow of a refrigerant through a tap 37 to the air conditioning economizer heat exchanger 32. A similar device 38 controls the flow from a tap 39 to the heat pump economizer heat exchanger 34. A return line 40 returns the tap flow back to the compressor 22. As is known, if the compressor 22 is an economized compressor, the return line 40 will preferably inject this return tapped refrigerant into the compression chambers at an intermediate point in the compression cycle. A line 42 returns the refrigerant from one of the indoor heat exchanger 28 (cooling mode) or outdoor heat exchanger 24 (heating mode) to the compressor 22, dependent upon the position of the four-way reversing valve 30.

While the expansion devices 36 and 38 are shown as single devices, the expansion and shut-off valve functions can be provided by two separate members.

Figure 2:
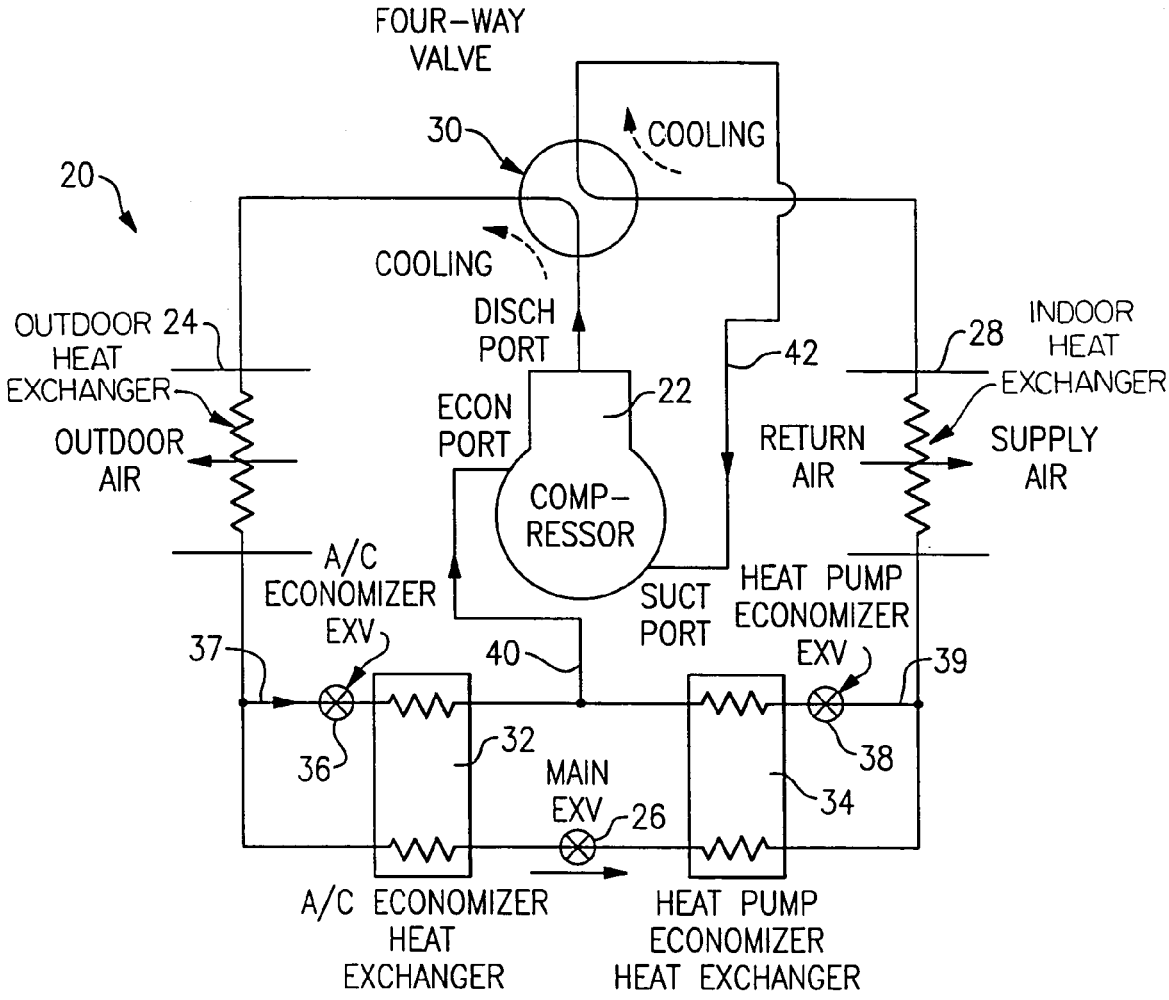
FIG. 2 shows the refrigerant cycle configured for cooling mode.

As shown in FIG. 2, the valve 30 is in the cooling position. Refrigerant passes serially from the compressor 22 to the outdoor heat exchanger 24, through the main expansion device 26, and to the indoor heat exchanger 28, then returning to the compressor 22 through the line 42. The refrigerant system may operate in a non-economizer mode. In such mode, both valves 36 and 38 are closed, and tapped refrigerant from tap lines 37 or 39 does not flow through either heat exchanger 32 or 34. As shown, the main refrigerant flow does continue to pass through both economizer heat exchangers 32 and 34.

However, under certain conditions, it may be desirable to provide an economizer cycle. Generally, the economizer cycle is operative when enhanced performance (capacity and efficiency) is desired. Under such a mode, the valve 36 is opened to provide an expansion function on refrigerant tapped through the line 37. At the same time, the valve 38 is tightly closed, blocking flow from the line 39. Refrigerant flowing through the economizer expansion device 36 is expanded and cooled. This cooler refrigerant subcools the main refrigerant stream also passing through the air conditioning economizer heat exchanger 32, preferably in counter-flow arrangement. That is, for illustration simplicity, the two flows are shown moving in the same direction through the economizer heat exchanger 32. In fact, it is preferred they move in opposed directions through the heat exchanger. The main refrigerant flow then moves into the main expansion device 36, and passes through the heat pump economizer heat exchanger 34, although the heat pump economizer heat exchanger 34 is performing no function in this mode. The tapped refrigerant from the line 37, after having passed through the air conditioning economizer heat exchanger 32 is returned through a line 40 to an intermediate compression point in the compressor 22.

Figure 3:
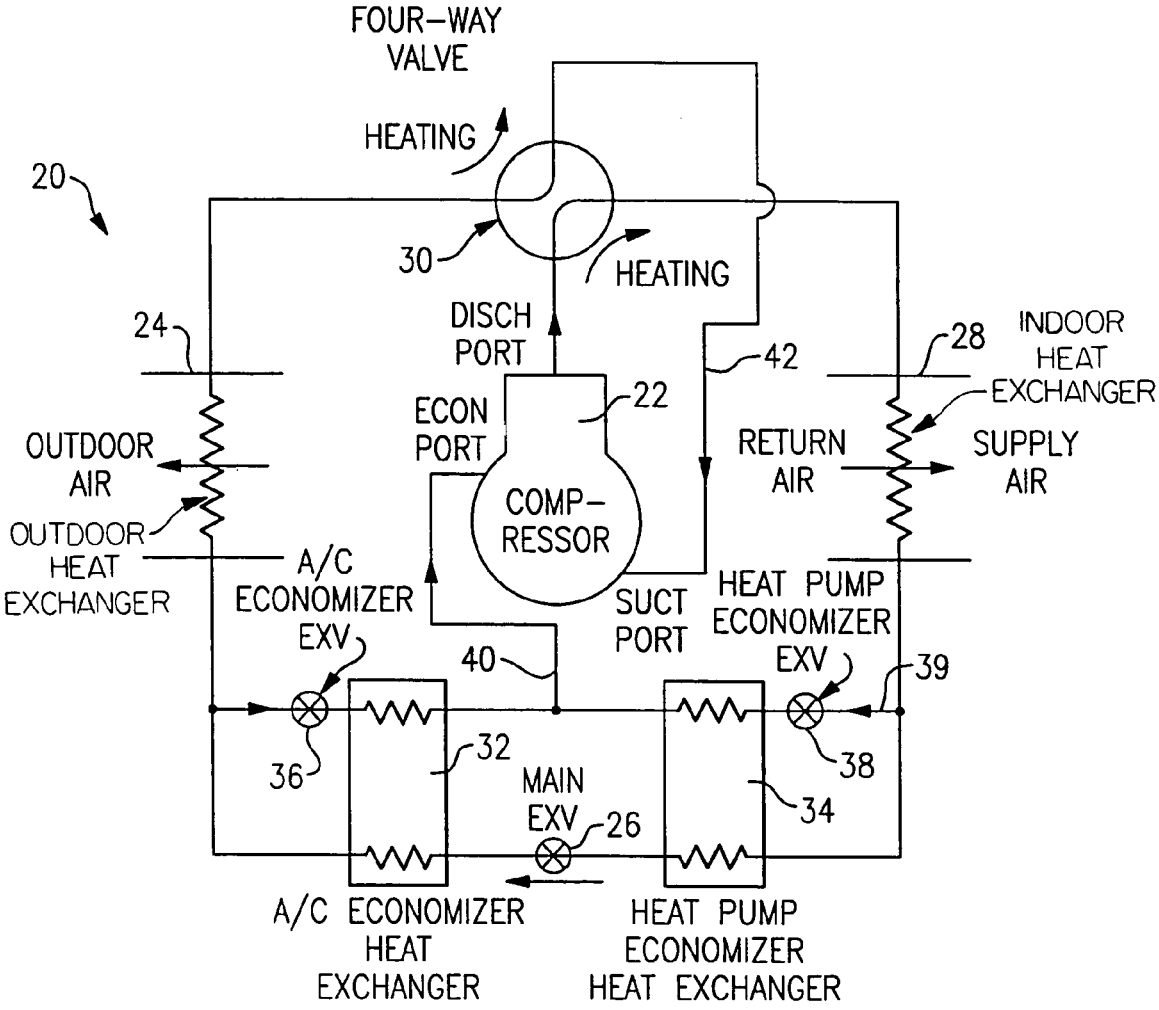
FIG. 3 shows the refrigerant cycle configured for heating mode.

FIG. 3 shows the refrigerant cycle 22, however now in a heating mode. The refrigerant from the compressor 22 passes to the indoor heat exchanger 28, to the main expansion device 26, and then the outdoor heat exchanger 24. From the outdoor heat exchanger 24, the refrigerant passes through the valve 30, then returns through the line 42 back to the compressor 22. Again, the system may operate in heating mode without any economizer cycle. Under such conditions, both valves 36 and 38 are maintained tightly closed. However, should an economizer cycle be desirable, then the valve 38 is opened to provide an expansion function, with the valve 36 remaining tightly closed. The refrigerant from the line 39 is now expanded by the expansion device 38, and subcools the main refrigerant flow in the heat pump economizer heat exchanger 34. The refrigerant is again returned through the line 40 back to the compressor 22.

A control for the system, operates the devices 36 and 38, and the valve 30, dependent on whether heating or cooling modes, and whether economizer cycles are desired. A worker of ordinary skill in the art would recognize how to provide an appropriate control.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

a compressor;

an outdoor heat exchanger;

a main expansion device;

an indoor heat exchanger;

a valve for selectively providing a refrigerant from said compressor to said outdoor heat exchanger in cooling mode, or to said indoor heat exchanger in a heating mode; and a pair of economizer taps, with a first of said economizer taps being positioned between said outdoor heat exchanger and said main expansion device, and a second economizer tap being positioned between said indoor heat exchanger and said main expansion device, and there being economizer expansion devices and valves positioned on each of said first and second taps and with a first and second economizer heat exchanger, with one positioned adjacent to each of said economizer expansion device and valves.

2. A refrigerant cycle as set forth in claim 1, wherein said economizer heat exchangers include economizer heat exchangers positioned on each of said first and second taps, and downstream of respective ones of said economizer expansion devices and valves.

3. A refrigerant cycle as set forth in claim 2, wherein an economizer return line is positioned on a line communicating said first and second economizer heat exchangers, and communicating refrigerant from said first and second taps back to said compressor.

4. A method of operating a refrigerant cycle comprising the steps of:

(1) providing a valve for selectively communicating a refrigerant from a compressor to a outdoor heat exchanger, or to an indoor heat exchanger, dependent on whether the refrigerant system is in a cooling or heating mode, providing a tap line for tapping refrigerant to provide an economizer function both downstream from said outdoor heat exchanger in a cooling mode and downstream from said indoor heat exchanger in a heating mode and providing separate economizer heat exchangers for both said cooling mode and said heating mode; and (2) determining that an economizer mode is desirable, and passing a tapped refrigerant into one of said economizer heat exchangers, and cooling a main refrigerant flow in said one of said economizer heat exchangers, with a second of said economizer heat exchangers being provided with a valve to block flow of said tapped refrigerant.

5. A method of operating a refrigerant cycle as set forth in claim 4, wherein said valve of step (1) is provided with a control, and a valve system to achieve step (2) is also controlled by such control, with said control of said valve of steps (1) and (2) being controlled simultaneously to achieve either cooling or heating mode, combined with economized operation.

* * * * *